US010145064B2

(12) United States Patent
Despault

(10) Patent No.: US 10,145,064 B2
(45) Date of Patent: Dec. 4, 2018

(54) HIGH STABILITY WARP DRYER FABRIC

(71) Applicant: AstenJohnson, Inc., Charleston, SC (US)

(72) Inventor: Marc P. Despault, Dunrobin (CA)

(73) Assignee: AstenJohnson, Inc., Charleston, SC (US)

( * ) Notice: Subject to any disclaimer, the term of this patent is extended or adjusted under 35 U.S.C. 154(b) by 24 days.

(21) Appl. No.: 15/304,646

(22) PCT Filed: Sep. 29, 2016

(86) PCT No.: PCT/US2016/054404

§ 371 (c)(1),
(2) Date: Oct. 17, 2016

(87) PCT Pub. No.: WO2017/059048

PCT Pub. Date: Apr. 6, 2017

(65) Prior Publication Data

US 2017/0314199 A1 Nov. 2, 2017

Related U.S. Application Data

(60) Provisional application No. 62/234,909, filed on Sep. 30, 2015.

(51) Int. Cl.
*D21F 7/08* (2006.01)
*D03D 11/00* (2006.01)
(Continued)

(52) U.S. Cl.
CPC ..... *D21F 1/0036* (2013.01)

(58) Field of Classification Search
CPC ..... D21F 1/0036; D21F 1/0027; D21F 7/083; D21F 1/0045; D03D 15/00; D03D 11/00; D03D 23/00; D03D 27/00
See application file for complete search history.

(56) References Cited

U.S. PATENT DOCUMENTS 2,180,054 A * 11/1939 Hindle ..... D21F 1/0036 139/383 A
4,854,352 A * 8/1989 Combier ..... D03D 11/00 139/408

(Continued)

FOREIGN PATENT DOCUMENTS

WO 199119044 12/1991
WO 2012140993 10/2012

*Primary Examiner* — Bobby Muromoto, Jr.
(74) *Attorney, Agent, or Firm* — Volpe and Koenig, P.C.

(57) ABSTRACT

An industrial textile formed from first and second systems of warp yarns interwoven with first, second, and third sets of weft yarns in a repeating pattern to provide a 2½ weft layer fabric construction is provided. One of each of the yarns of the first and second sets of weft yarns are arranged so as to form a vertically aligned pair with respect to one another, and the third set of weft yarns is located intermediate of the first and second sets of weft yarns between vertically aligned pairs from the first and second sets. Each of the warp yarns in the first system of warp yarns is interwoven only with the weft of the first and third sets, and each of the warp yarns of the second system of warp yarns is interwoven only with the weft yarns of the second and third sets. The warp yarns of the first and second systems of warp yarns are arranged as vertically stacked pairs.

12 Claims, 4 Drawing Sheets

(51) Int. Cl.
*D21F 1/00* (2006.01)
*D03D 15/00* (2006.01)

(56) References Cited

U.S. PATENT DOCUMENTS 5,114,777 A * 5/1992 Gaisser ..... D21F 1/0036 139/35
5,117,865 A * 6/1992 Lee ..... D21F 1/0036 139/383 A
5,254,398 A * 10/1993 Gaisser ..... D21F 1/0036 139/35
6,773,786 B1 * 8/2004 Kuckart ..... D21F 1/0027 34/111
7,059,357 B2 * 6/2006 Ward ..... D21F 1/0045 139/348
7,861,747 B2 * 1/2011 Quigley ..... D21F 1/0045 139/383 A
2002/0060056 A1 * 5/2002 Harrison ..... B60C 9/18 162/100
2003/0084955 A1 * 5/2003 Smith ..... D03D 23/00 139/420 A
2004/0099328 A1 * 5/2004 Rougvie ..... D21F 1/0036 139/383 A
2004/0102118 A1 * 5/2004 Hay ..... D21F 1/0036 442/239
2004/0182465 A1 * 9/2004 Ward ..... D21F 1/0045 139/383 A
2009/0205740 A1 * 8/2009 Quigley ..... D21F 1/0045 139/408
2010/0000695 A1 * 1/2010 Quigley ..... D21F 1/0027 162/227
2011/0030909 A1 * 2/2011 Danby ..... D21F 1/0045 162/358.2
2014/0127959 A1 * 5/2014 Usuki ..... D03D 11/00 442/240

* cited by examiner 8 shed pattern template

| Step | 1 | 2 | 3 | 4 | 5 | 6 | 7 | 8 | 9 | 10 | 11 | 12 | 13 | 14 | 15 | 16 | x1 | x2 | Weft | Step | Measur. tension |
|---|---|---|---|---|---|---|---|---|---|---|---|---|---|---|---|---|---|---|---|---|---|
| 1 | | 2 | | | | | | | | 10 | | | | | | | X1 | | P1 | 1 | |
| 2 | | 2 | 3 | | | 6 | | 8 | | 10 | 11 | | | 14 | | 16 | | X2 | S1 | 2 | X |
| 3 | 1 | 2 | 3 | 4 | | 6 | 7 | 8 | 9 | 10 | 11 | 12 | | 14 | 15 | 16 | X1 | | M1 | 3 | |
| 4 | | | | | | 6 | | | | | | | | 14 | | | | X2 | P1 | 4 | |
| 5 | | 2 | | 4 | | 6 | 7 | | | 10 | | 12 | | 14 | 15 | | X1 | | S1 | 5 | |
| 6 | | 2 | 3 | 4 | 5 | 6 | 7 | 8 | | 10 | 11 | 12 | 13 | 14 | 15 | 16 | | X2 | M1 | 6 | |
| 7 | | | | 4 | | | | | | | | 12 | | | | | X1 | | P1 | 7 | |
| 8 | | | | 4 | 5 | 6 | | 8 | | | | 12 | 13 | 14 | | 16 | | X2 | S1 | 8 | X |
| 9 | 1 | 2 | | 4 | 5 | 6 | 7 | 8 | 9 | 10 | | 12 | 13 | 14 | 15 | 16 | X1 | | M1 | 9 | |
| 10 | | | | | | | | 8 | | | | | | | | 16 | | X2 | P1 | 10 | |
| 11 | 1 | 2 | | 4 | | | | 8 | 9 | 10 | | 12 | | | | 16 | X1 | | S1 | 11 | |
| 12 | 1 | 2 | 3 | 4 | 5 | 6 | | 8 | 9 | 10 | 11 | 12 | 13 | 14 | | 16 | | X2 | M1 | 12 | |

HIGH STABILITY WARP DRYER FABRIC

INCORPORATION BY REFERENCE

The following documents are incorporated herein by reference as if fully set forth: U.S. Provisional Patent Application No. 62/234,909, filed Sep. 30, 2015.

BACKGROUND

The invention relates to industrial textiles, and more particularly to papermaking fabrics.

Numerous weaves are known in the art which are employed to achieve different results for different applications.

SUMMARY

The invention concerns an industrial textile suitable for use as a dryer fabric in a papermaking machine. The industrial textile is woven according to a 2½ weft layer weave construction in which a first set of weft yarns is located to the paper side (PS) surface, a second set is located to the machine side (MS) surface and a third set is positioned intermediate to and adjacently between each of the yarns of the first and second weft yarn sets (i.e.: to provide the 2½ layer construction; if all of the weft were stacked directly over one another, the fabric would have a 3 weft layer construction as shown in FIG. 5A).

These three sets of weft yarns are interwoven into a unified fabric using two independent, vertically stacked warp yarn systems. Each warp system is interwoven with the weft yarns according to identical but inverted patterns relative to one another. The term "vertically stacked" refers to the relative vertical position of the warp yarns of each of the first and second warp yarn systems in the textile: each warp yarn of the first warp yarn system is located directly over and is vertically aligned with a warp yarn in the second warp yarn system. The first warp yarn system interweaves with the first and third sets of weft yarns to form a first outer layer of the fabric (which could be either the PS or MS layer). The second warp yarn system interweaves with the second and third weft yarn sets to form the second outer layer of the fabric (which would be the opposite MS layer in the first instance). Both warp systems interweave with the centrally located (or intermediate) third weft yarn set to bind the two outer layers together as a unified fabric.

The warp yarns preferably have a generally rectangular cross-sectional shape as this contributes to the stability of the fabric and its smoothness. The yarns may be grooved and/or profiled in the manner described by Kuckart U.S. Pat. No. 6,773,786 to assist in rendering the fabric contamination resistant. The weft yarns preferably have a circular cross-section shape, but other shapes (e.g. ovate) may be employed.

The resulting construction is a rugged and wear resistant industrial textile that is highly stable (meaning it is resistive to out of plane distortion due in part to its stiffness). The fabric is adaptable to a wide range of applications by appropriate selection of warp and weft yarn types, sizes and shapes. For example, air permeability of the fabric is easily adjusted according to need; the fabric can be rendered temperature or contamination resistant by appropriate selection of the warp yarn materials and sizes. In addition the fabric exhibits high seam strength due to the stacked warp construction which utilizes 100% of the warp yarns to form the seam, and which also provides the fabric with a 200% warp fill. The term "warp fill" refers to the amount of warp yarns in a given space relative to total space considered. Warp fill can be over 100% when there are more warp strands jammed into the available space than the space can dimensionally accommodate in a single plane. A fabric with 200% warp fill or more may have two layers of warp yarns each woven at at least 100% warp fill. The fabric is highly stable, and resists creasing and distortion due to the fact that the warp yarns in each layer are woven at 100% warp fill, or more, and are thus immediately adjacent to, and braced against one another. The 2½ layers of weft yarns further contribute to fabric stability by augmenting cross-machine direction (CD) stiffness.

The unique construction of the industrial textile is efficient to manufacture as it uses 35% less weft yarns than would comparable three weft layer fabric constructions (such as prior art FIG. 5). The fabric is easy to weave using existing looms and does not require re-setting the loom from existing stacked warp products (e.g. such as those produced according to Lee U.S. Pat. No. 5,117,865 and others—known by product name MonoTier® from the present assignee, AstenJohnson, Inc.). A further benefit provided by the unique fabric construction is that, because the fabric is symmetrical (top and both are the same) it is amenable to automated seaming so as to form seaming loops at each opposing end for a pin seam to join the fabric and render it endless. Certain fabric designs, such as that shown in FIGS. 5A and 5B cannot be seamed by machine; seams for those fabrics must be formed manually which may require several days and will drive up the manufacturing costs substantially. The ability to apply automated seaming technology to the fabric design provides a substantial saving in labor and associated manufacturing costs.

The weave pattern of the novel fabric provides it with relatively longer floats of the warp yarns on both exterior surfaces; these floats enhance its ability to resist abrasive wear. The fabric design can be adapted for many different applications by proper warp and weft selection which will allow the fabric to obtain a wide range of air permeabilities. Although fabric caliper (thickness) can be made low to allow for use in high speed applications, the stability of the textile is maintained due to the warp yarn bracing and high CD stiffness provided by the layers of weft yarns. The two independent warp systems provide a further benefit in that the materials used in each can be optimized to resist the environmental effects to which each fabric surface exposed. For example, the monofilament warp yarns used to form a first fabric surface can be comprised of PPS (polyphenylene sulfide) or PCTA (polycylcohexane dimethanol terephthalic acid) polymers which are more resistant to thermal and hydrolytic degradation than PET (polyethylene terephthalate) yarns (and more expensive). Warp yarns formed from PET polymer could be utilized on the PS of the textile where heat and hydrolysis resistance are less critical properties; these yarns may be grooved or otherwise profiled for contamination resistance.

Fabrics according to the invention such as are shown in the Figures were woven using rectangular cross-section polymeric monofilament warp yarns whose dimensions are 0.25×1.05 mm or 0.36×1.07 mm to obtain a width to height ratio of between 4:1 and 3:1 but other cross-sectional shapes and ratios may be employed. The weft yarns used in these fabrics have a generally circular cross-sectional shape and ranged in size from about 0.50 mm to 1.0 mm; other sizes may be employed depending upon need. The fabric was woven at 40 picks per inch (weft yarns per inch).

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Certain terminology is used in the following description for convenience only and is not limiting. The fabric according to the invention is an industrial textile, which can have many industrial applications, such as conveyor belts, filter fabrics, etc. The words "paper side" and "machine side" designate surfaces of the fabric with reference to their use in one preferred application in a papermaking machine; however, these terms merely represent first and second or upper and lower surfaces of the planar fabric. "Yarn" is used to generically identify a monofilament or multifilament fiber. "Warp" and "weft" are used to designate yarns or monofilaments based on their position in the loom that extend in perpendicular directions in the fabric and either could be a machine direction (MD) or cross-machine direction (CMD) yarn in the fabric once it is installed on a papermaking machine, depending on whether the fabric is flat woven or continuously woven. In the preferred arrangement, the fabric is flat woven and seamed at the warp ends in order to form a continuous belt, so that the warp yarns are MD yarns and the weft yarns are CMD yarns.

One preferred application of the fabrics according to the invention is on a papermaking machine, and the fabric could have application as a forming fabric, a press fabric, or a dryer fabric for use in the corresponding forming, press, and dryer sections of a papermaking machine. These are generally all referred to as a "papermaking fabric" regardless of the position of use in a papermaking machine.

Figure 1:
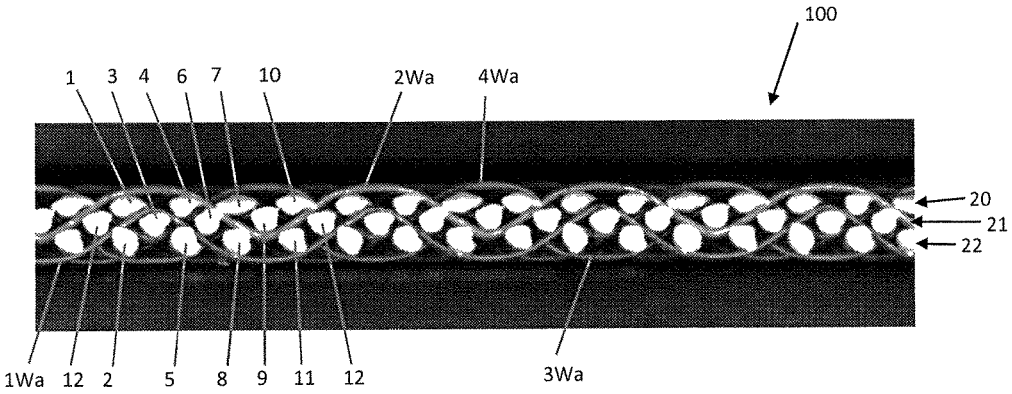
FIG. 1 is a cross-sectional view of a fabric according to the invention taken parallel to the warp yarns.

FIG. 1 shows a cross-section taken parallel to the warp yarns in a portion of an industrial textile according to the invention. As shown, the fabric 100 includes a first system of warp yarns of which yarns 2Wa and 4Wa are exemplary, and a second system of warp yarns of which yarns 1Wa and 3Wa are exemplary. The fabric also includes three sets of weft yarns; a first weft yarn set 20 is located proximate to a first surface of the fabric, a second weft yarn set 22 is located proximate to a second surface of the textile while an intermediate weft yarn set 21 is located intermediate to the first and second weft yarn sets. FIG. 1 shows several repeats of the warp yarn interweaving pattern, the entirety of which is presented in the weave diagram of FIG. 4A.

Figure 4A:
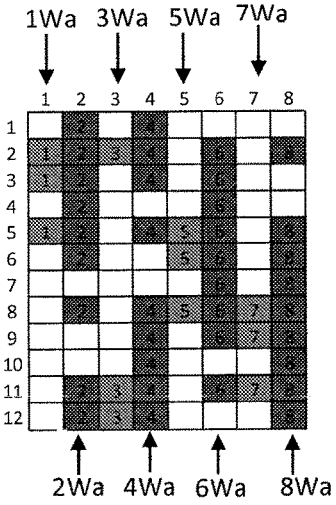
FIG. 4A presents a weave diagram showing one full repeat of the fabric.

As shown in FIGS. 1 and 4A, warp yarn 1Wa passes under weft 1 (of the first weft yarn set 20), over weft 2 (of second set 22), over weft 3 (of intermediate set 21), under weft 4, over weft 5 and then under wefts 6 through 12 at which point the pattern repeats. In the same repeat, warp yarn 2Wa passes over wefts 1 through 6, under weft 7, over weft 8, under weft 9 (of intermediate weft yarn set 21), under weft 10 (of the first weft yarn set 20) and over wefts 11 and 12 (of the second weft yarn set 22) to complete the pattern. Adjacent warp yarn 4Wa follows a similar pattern but is offset longitudinally in the fabric by 3 weft yarns; similarly warp 3Wa follows the same patterns as warp 1Wa but offset by 3 weft yarns. In each repeat of the warp interweaving pattern, each warp ties into/wraps around a weft yarn of the intermediate weft yarn set 21; warp 1Wa wraps around weft yarn 3 of intermediate weft yarn set 21, while warp yarn 2Wa wraps around weft yarn 9 of intermediate weft yarn set 21, thus tying the outside layers of the fabric together into a unified structure.

Inspection of FIG. 1 shows that the warp yarns such as 2Wa and 4Wa forming a first surface of the fabric 100, are interwoven with weft yarns from weft yarn sets 20 and 21, while the warp yarns such as 1Wa and 3Wa which form a second surface of the textile 100 are interwoven with the weft yarns of weft yarn sets 22 and 21. Because both systems of warp interweave with the weft yarns of the intermediate weft yarn set 21, a unified fabric construction is provided. In addition, the weft yarns of weft yarn sets 20 and 22 are arranged so as to form vertically stacked non-contacting pairs, while the weft yarns of intermediate weft yarn set 21 are offset with respect to each stacked pair of weft yarn sets 20 and 22 and are located in between each.

Figure 4B:
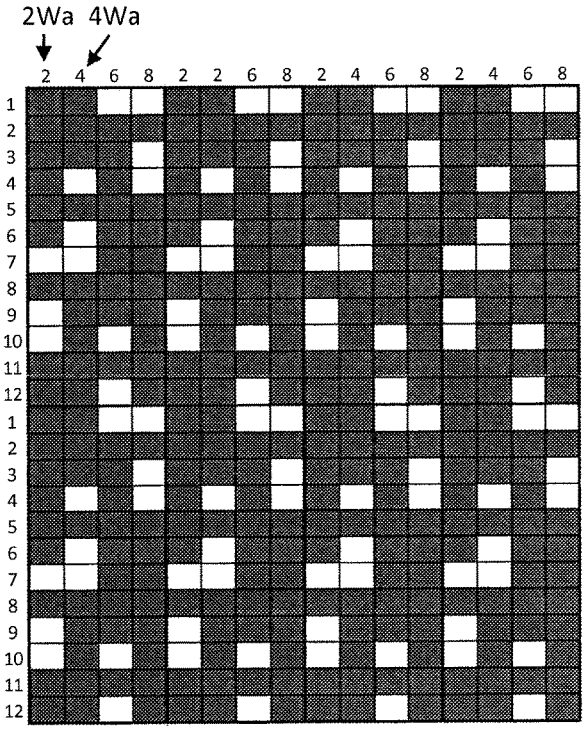
FIG. 4B presents multiple repeats of the weave pattern of the one fabric surface.

The complete weave pattern of the fabric 100 shown in FIG. 1 is presented in FIG. 4A; the pattern provided in FIG. 4B shows the arrangement of the warp yarns on a first (e.g. paper side) surface of the fabric, and is identical to the corresponding arrangement on the opposite second surface. The first set of warp yarns is indicated in FIG. 4A at 2Wa, 4Wa, 6Wa, 8Wa, and the second set of warp yarns is indicated at 1Wa, 3Wa, 5Wa, 7Wa. This is for an 8 shed weave. However, this is merely exemplary and could be varied.

Figure 2:
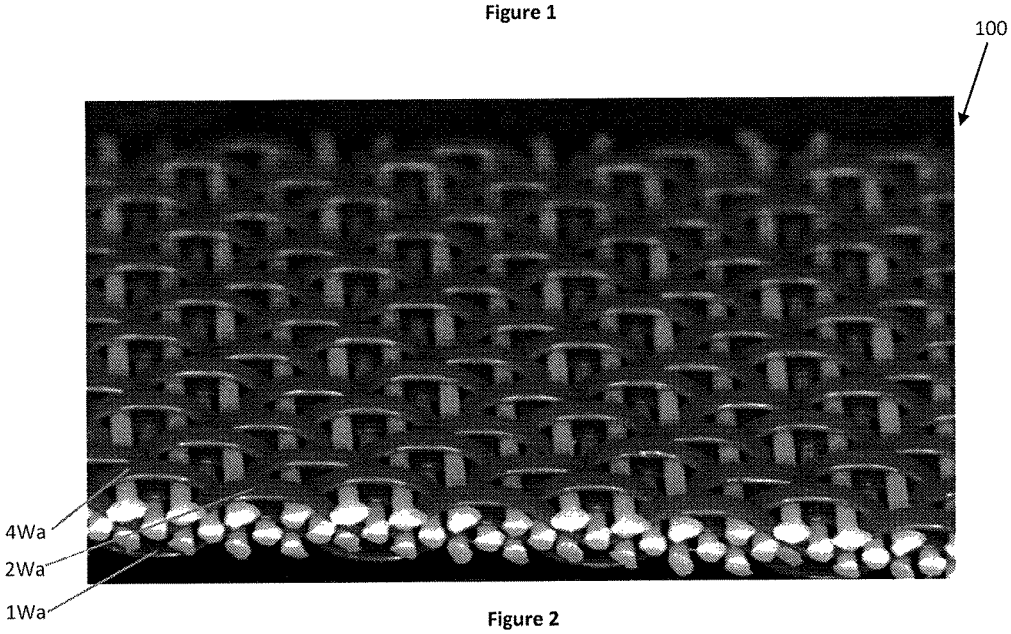
FIG. 2 is a perspective view of a first surface of the fabric shown in FIG. 1.

FIG. 2 shows a perspective view of the textile 100 presented in FIG. 1. As can be seen, the warp yarns 2Wa and 4Wa of the first system of warp yarns are interwoven with the weft yarns of weft yarn sets 20 and 21 to form a first surface of the fabric. Each warp yarn 2Wa and 4Wa forms a "float" over 5 weft yarns of weft yarn sets 20 and 21 as described above in relation to FIG. 1; e.g. warp 2Wa passes over weft yarns 1, 3, 4, 6, & 12. In relation to the complete fabric pattern, each of the warp yarns passes over 9 weft in one repeat of the weave pattern; e.g. warp 2Wa passes over weft yarns 1, 2, 3, 4, 5, 6, 8 11 & 12. All of the warp yarns in the fabric are interwoven with the weft yarns in the identical manner as described in the weave diagram presented in FIG. 4.

Figure 3:
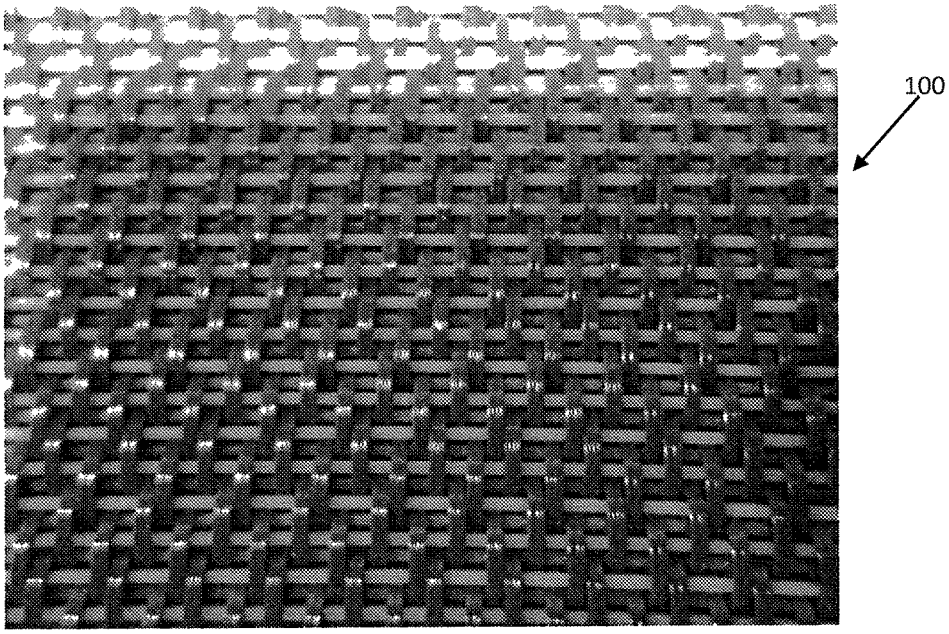
FIG. 3 is a plan view of a first surface of the fabric shown in FIG. 1 or 2 (both fabric surfaces are identical)

FIG. 3 is a planar perspective view of the fabric shown in FIGS. 1 and 2 and clearly shows the floats of the warp yarns on a first surface of the fabric. The warp yarn floats on the second surface of the fabric will be identical to those on the first. At each surface of the fabric, each warp yarn floats over 5 weft yarns, including two from either weft sets 20 or 22, and three weft yarns from intermediate yarn set 21; the arrangement of the floats on each surface can be adjusted according to requirements. For example, the fabric of FIG. 3 is woven to provide a "herringbone" type arrangement of the warp floats, but the floats could also be arranged according to a twill or broken twill pattern by simple adjustment of the weave pattern which would be apparent to one skilled in the art based on the present disclosure.

FIG. 4A presents one weave pattern repeat of the fabric shown in FIGS. 1 to 3. The interweaving pattern of warp yarns 1Wa-8Wa shown in FIGS. 1 and 2 are indicated. FIG. 4B provides the weave pattern of one planar surface of the fabric shown in FIG. 4A with warp yarns 2Wa and 4Wa indicated.

The warp yarns 1Wa-8Wa preferably have a generally rectangular cross-sectional shape as this contributes to the stability of the fabric and its smoothness. In two preferred arrangements, rectangular cross-section polymeric monofilament warp yarns whose dimensions are 0.25×1.05 mm or 0.36×1.07 mm to obtain a width to height ratio (aspect ratio) of between 4:1 and 3:1 are used. However, those skilled in the art will recognize that other cross-sectional shapes and ratios may be employed, such as oval or flattened shapes with rounded sides, and aspect ratios of 2:1 to 6:1. The weft yarns 1-12 used in these fabrics have a generally circular cross-sectional shape and in some preferred arrangements may range in size from 0.6 mm, 0.7 mm, 0.8 mm or 0.9 mm; other yarn sizes may be employed to provide satisfactory results depending on the intended end use application of the fabric. Good results may also be obtained by using weft yarns in which a portion of their cross-sectional area is hollow; such hollow yarns may be located in any position (either exterior layer, or intermediate layer) but may be preferentially located to an exterior layer. However, those skilled in the art will recognize that other sizes may be employed depending upon need. In one preferred arrangement, the fabric 100 is woven at 40 picks per inch (weft yarns per inch) (or 15.7 yarns/cm).

Testing has shown high CD stiffness achieved for 2½ layer fabrics according to the preferred arrangement, with fabrics woven with 0.8 mm diameter yarns providing the same CD stiffness of the current 3 layer fabrics woven with 0.6 mm diameter weft yarns, and fabrics woven with 0.9 mm diameter yarns exceeding the CD stiffness of the current 3 layer fabrics.

The fabric 100 exhibits high seam strength due to the stacked warp construction which utilizes 100% of the warp yarns 1Wa-8Wa to form the seam, and which also provides the fabric with a 200% warp fill. The seams can be formed in a known manner by unweaving and back-weaving warp yarns 2Wa, 4Wa, 6Wa, 8Wa from the first surface back into the fabric along the paths of the corresponding stacked one of the warp yarns 1Wa, 3Wa, 5Wa, 7Wa from the second layer that have been cut back from the end of the fabric to form seam loops at each end of the planar fabric, with the seam loops then being interdigitated and joined by a pintle to form an endless fabric loop. Here the warp fill is preferably about 200% warp fill, with each layer having warp yarns woven at about 100% warp fill. This results in the fabric 100 being highly stable, and resists creasing and distortion due to the fact that the warp yarns 1Wa-8Wa in each layer are woven at about 100% warp fill, or more, and are thus immediately adjacent to, and braced against one another. This also maintains the stacked arrangement of the warp yarns in corresponding pairs 1Wa, 2Wa; 3Wa, 4Wa, etc.

The two independent warp systems provide a further benefit in that the materials used in each can be optimized to resist the environmental effects to which each fabric surface exposed. For example, the monofilament warp yarns 2Wa, 4Wa, 6Wa, 8Wa used to form a first fabric surface can be comprised of PPS (polyphenylene sulfide) or PCTA (polycylcohexane dimethanol terephthalic acid) polymers which are more resistant to thermal and hydrolytic degradation than PET (polyethylene terephthalate) yarns (and more expensive). The warp yarns 1Wa, 3Wa, 5Wa, 7Wa of the second set can be formed from PET polymer since the PS of the textile is where heat and hydrolysis resistance are less critical yarn properties. These warp yarns 1Wa-8Wa may be grooved, profiled, coated, or otherwise treated for contamination resistance. Those skilled in the art will understand from the present disclosure that these materials are merely exemplary, and that other materials could be used depending on the particular application.

Additionally, due to the long warp floats, a higher contact area can be achieved that reduces fabric wear rates in comparison to similar fabrics having more defined knuckles due to the weave. The long warp floats also provide for benefits in contamination resistance in comparison to similar weft proud fabrics.

Figure 5A:
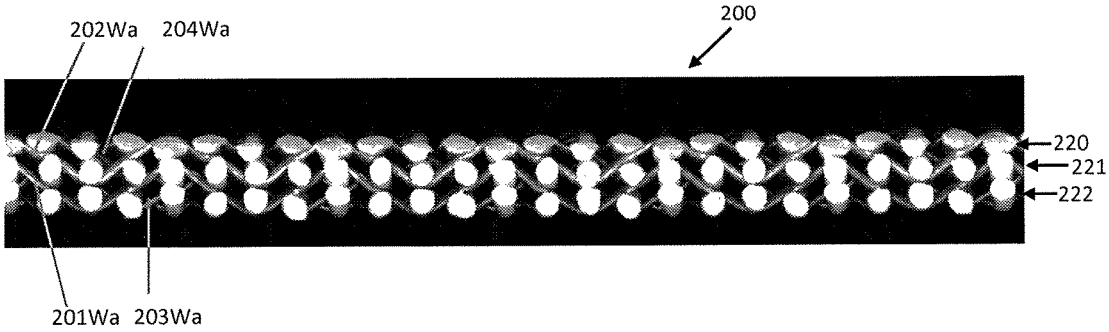
Figure 5A (Prior Art)
FIG. 5A is a cross-sectional view taken parallel to the warp yarns of a prior art three weft layer fabric construction.
Figure 5B:
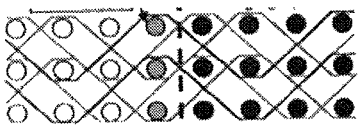
Figure 5B (Prior Art)
FIG. 5B is the weave diagram and pattern of the prior art fabric shown in FIG. 5A.

FIGS. 5A-5B and 6A-6B each provide examples of prior art industrial textiles. FIG. 5A is a photograph of a cross-section taken along the warp yarns of a triple weft layer fabric 200. In this fabric the weft yarns 220, 221 and 222 are all vertically stacked forming first, second (intermediate) and third fabric layers which are interwoven into a unified fabric structure using two sets of warp yarns. Warp yarns 202Wa and 204Wa are representative of warp yarns of the first set and each interweave with the weft yarns 220 and 221 of the first and intermediate layers of weft yarns. Warp yarns 201Wa and 203Wa interweave with the weft yarns 221 and 222 of the second (intermediate) and third layers of weft yarns. The warp yarns 202Wa and 204Wa, and 201Wa and 203Wa of the first and second sets all interweave with the weft yarns of the second (intermediate) layer of weft yarns so as to bind the fabric together. However, in comparison to the inventive fabric shown in FIGS. 1 to 4, the weft yarns of the second (intermediate) layer 221 are not offset with respect to the weft yarns of the vertically stacked yarns of the first and third layers 220 and 222 and are not located in between each. Further, the warp yarns 201Wa, 203Wa, 202Wa, and 204Wa form single knuckles on the exterior surfaces of the fabric (and pass over 4 weft yarns in the repeat) whereas, in the fabric 100 of the invention, the warp yarns 1Wa-8Wa form floats passing over 5 weft yarns of the respective outer layer. This provides for better support for a paper sheet being carried, longer wear due to the longer surface floats, as well as a reduced caliper for the fabric 100 in comparison with this prior art. Further, it uses less weft yarns, reducing material costs.

FIG. 6 presents a depiction of a second prior art fabric 300. The fabric consists of one set of warp yarns identified as 1Wa and 2Wa which are interwoven with weft yarns 320, 321 and 322 arranged in a 2½ layer construction. Unlike the fabric of the invention, there is only one set of warp which interweave with all of the weft 320, 321 and 322 located in each of the top, intermediate and bottom layers of the fabric (i.e. the warp yarns are not stacked in this construction). In addition, although each warp yarn 301Wa and 302Wa passes over 6 weft in each repeat, 3 weft are from the bottom layer i.e. 322, two are from intermediate layer 321 and one is from top layer 320.

Fabrics according to the invention were woven using 0.9 mm weft yarns in each of the three weft yarn sets and are generally rectangular warp yarns having dimensions 0.25×

Figure 5B:
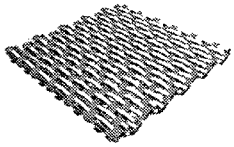
Figure 5B (Prior Art)
Figure 6A:
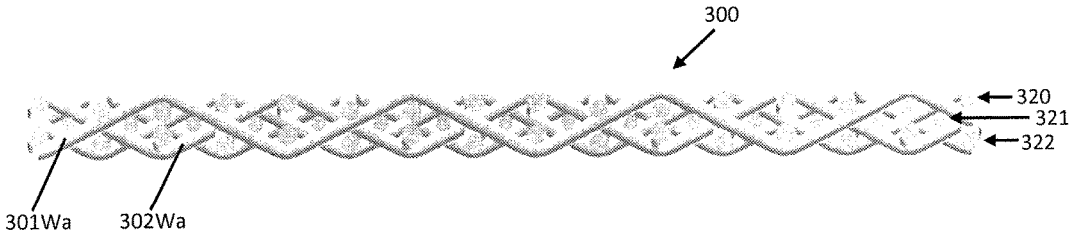
Figure 6A (Prior Art)
FIG. 6A is a cross-sectional view taken parallel to the warp yarns of a second prior art fabric having a 2½ weft layer construction.
Figure 6B:
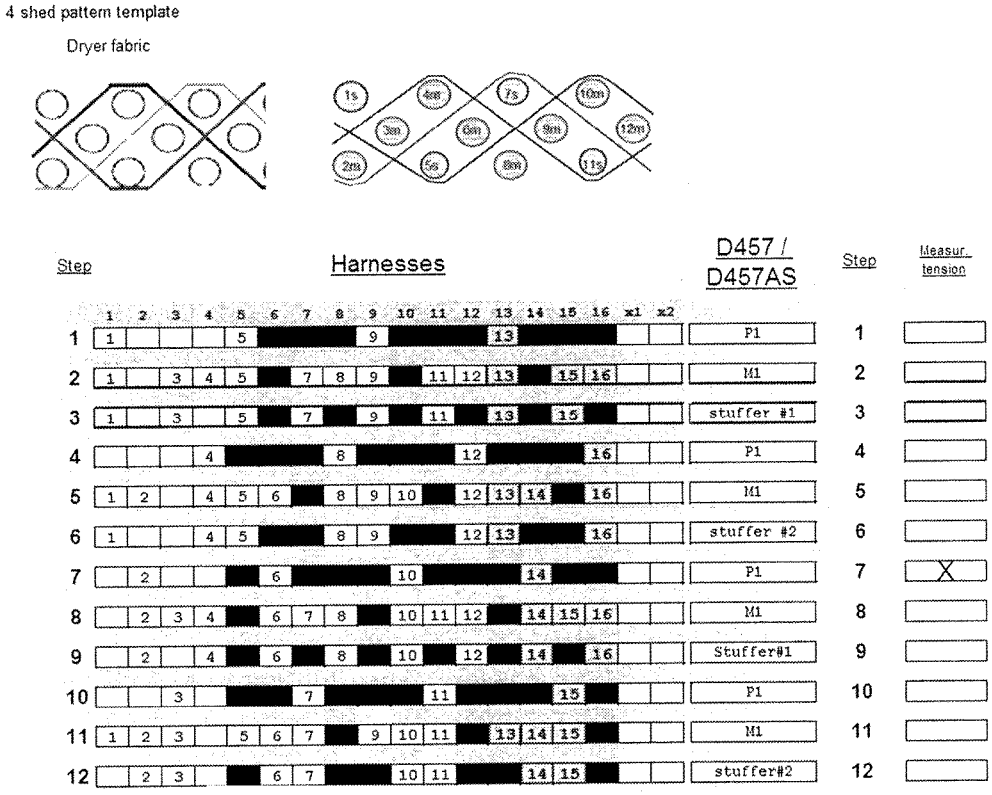
Figure 6B (Prior Art)
FIG. 6B is the weave diagram and pattern of the prior art fabric shown in FIG. 6A.

1.05 mm; fabrics according to the prior art FIG. 5 design were also produced using the same sized warp yarns and weft yarns in each of the top, middle and bottom positions that were 0.6 mm in diameter. The stiffness of each fabric was tested; the inventive fabric exhibited a stiffness of 73 daN while the stiffness of the prior art fabric was found to be 56 daN. A second sample of a fabric according to the invention was woven using 0.6 mm weft yarns in all positions and was found to have a stiffness of 28 daN. Fabric stiffness increases with increasing weft yarn size.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A warp-tied conveying and filtering fabric having first and second planar surfaces, the fabric comprising:

first and second systems of warp yarns interwoven with first, second, and third sets of weft yarns in a repeating pattern to provide a 2½ weft layer fabric construction in which:

the first set of weft yarns is located proximate to the first planar surface, the second set of weft yarns is located proximate to the second planar surface one of each of the yarns of the first and second sets of weft yarns are arranged so as to form a vertically aligned pair with respect to one another, and the third set of weft yarns is located intermediate of the first and second sets of weft yarns with a respective one of the weft yarns of the third set being located adjacent to each of the vertically aligned pairs of weft yarns from the first and second sets;

each of the warp yarns in the first system of warp yarns is interwoven only with the weft yarns of the first and third sets, and at least one of the warp yarns in the first system of warp yarns at least one of ties into or wraps around the weft yarns of the third set;

each of the warp yarns of the second system of warp yarns is interwoven only with the weft yarns of the second and third sets, and at least one of the warp yarns of the second system of warp yarns at least one of ties into or wraps around the weft yarns of the third set;

the warp yarns of the first and second systems of warp yarns are arranged as vertically stacked pairs; and the first system of warp yarns and the second system of warp yarns each have at least about 100% warp fill.

2. The warp-tied conveying and filtering fabric of claim 1, wherein the first and second planar surfaces have an identical weave pattern.

3. The warp-tied conveying and filtering fabric of claim 1, wherein the first system of warp yarns is made from a different material than the second set of warp yarns.

4. The warp-tied conveying and filtering fabric of claim 1, wherein the warp yarns of the first and second systems of warp yarns have a rectangular cross-section.

5. The warp-tied conveying and filtering fabric of claim 4, wherein the cross-section of the warp yarns of the first and second systems of warp yarns are the same.

6. The warp-tied conveying and filtering fabric of claim 1, wherein the warp yarns of the first system of warp yarns have floats on the first planar surface over five of the weft yarns from the first and third sets of weft yarns.

7. The warp-tied conveying and filtering fabric of claim 1, wherein the first and second systems of warp yarns woven with an 8 shed repeat.

8. The warp-tied conveying and filtering fabric of claim 1, wherein the warp yarns of the first and second systems of warp yarns provide at least about 200% warp fill.

9. The warp-tied conveying and filtering fabric of claim 1, wherein the fabric is a papermaking fabric.

10. The warp-tied conveying and filtering fabric of claim 1, wherein the fabric is a papermaking dryer fabric.

11. The warp-tied conveying and filtering fabric of claim 1, wherein the warp yarns have a thickness of 0.25 or 0.36 mm and the third system of weft yarns have a diameter of 0.5 mm to 1.0 mm.

12. The warp-tied conveying and filtering fabric of claim 1, wherein the warp yarns have a thickness that is less than a diameter of the weft yarns.

* * * * *